US011166603B1

(12) United States Patent
Smith

(10) Patent No.: US 11,166,603 B1
(45) Date of Patent: Nov. 9, 2021

(54) WALL-MOUNTED BACK SCRUBBER APPARATUS

(71) Applicant: Jeanette A. Smith, Greenville, NC (US)

(72) Inventor: Jeanette A. Smith, Greenville, NC (US)

( * ) Notice: Subject to any disclaimer, the term of this patent is extended or adjusted under 35 U.S.C. 154(b) by 0 days.

(21) Appl. No.: 16/870,311

(22) Filed: May 8, 2020

(51) Int. Cl.

| | |
|---|---|
| ***A47K 7/02*** | (2006.01) |
| ***A46B 13/02*** | (2006.01) |
| ***A46B 9/06*** | (2006.01) |
| ***A46B 13/00*** | (2006.01) |

(52) U.S. Cl.
CPC ..... *A47K 7/024* (2013.01); *A46B 9/06* (2013.01); *A46B 13/008* (2013.01); *A46B 13/02* (2013.01); *A46B 2200/1006* (2013.01)

(58) Field of Classification Search
CPC ..... A47K 7/024; A46B 13/008; A46B 2200/1006
See application file for complete search history.

(56) References Cited

U.S. PATENT DOCUMENTS

| | | | | |
|---|---|---|---|---|
| 3,196,867 | A * | 7/1965 | Perry | A47K 7/04 601/114 |
| 5,345,640 | A | 9/1994 | Goss | |
| 6,996,861 | B1 | 2/2006 | Clark, Jr. | |
| 7,120,947 | B1 | 10/2006 | Magallanes | |
| 7,451,513 | B2 | 11/2008 | Torres | |
| 8,272,799 | B1 | 9/2012 | Yard | |
| D677,003 | S | 2/2013 | Jones | |
| 8,458,840 | B2 * | 6/2013 | Galindo Sanchez | A47K 7/04 15/21.1 |
| 2005/0229347 | A1 * | 10/2005 | Dent D'Almuano | A47K 7/024 15/160 |
| 2008/0250594 | A1 | 10/2008 | Green | |
| 2009/0241257 | A1 * | 10/2009 | Malta | A47K 7/024 4/606 |
| 2011/0145986 | A1 | 6/2011 | Rowles | |

* cited by examiner

*Primary Examiner* — Randall E Chin

(57) ABSTRACT

A wall-mounted back scrubber apparatus for cleaning one's back in the shower includes a housing having a housing defining a housing inside. The housing front side has a central aperture and a plurality of secondary apertures extending through to the housing inside. A plurality of suction cups is coupled to the housing back side and is configured to selectively engage a shower wall. A motor is coupled to the housing within the housing inside and has a motor shaft extending through the central aperture. A central brush is coupled to the motor shaft and a central gear is coupled to the motor shaft within the housing inside to drive a plurality of secondary gears attached to a plurality of gear shafts coupled to the housing back side and extending through the plurality of secondary apertures. A plurality of secondary brushes is coupled to the plurality of gear shafts.

10 Claims, 5 Drawing Sheets

WALL-MOUNTED BACK SCRUBBER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bathing accessibility devices and more particularly pertains to a new bathing accessibility device for cleaning one's back in the shower.

(2) Description of Related Art Including Information Disclosed Under 37 CFR 1.97 and 1.98

The prior art relates to bathing accessibility devices for washing a user's back. Existing devices typically incorporate stationary brushes while others motorize a series of brushes with either a series of motors or with a complex pulley system. What is needed, and what the present invention provides, is a robust single motor device to drive multiple scrubbing brushes.

BRIEF SUMMARY OF THE INVENTION

An embodiment of the disclosure meets the needs presented above by generally comprising a housing having a housing front side, a housing back side, a housing left side, a housing right side, a housing top side, and a housing bottom side defining a housing inside. The housing front side has a central aperture and a plurality of secondary apertures extending through to the housing inside. A plurality of suction cups is coupled to the housing. Each suction cup is coupled to the housing back side and is configured to selectively engage a shower wall. A motor is coupled to the housing within the housing inside. The motor has a motor shaft extending through the central aperture. A central brush is coupled to the motor shaft and a central gear is coupled to the motor shaft within the housing inside. A plurality of gear shafts is coupled to the housing. Each gear shaft is rotatably coupled to the housing back side and extends through the plurality of secondary apertures. A plurality of secondary gears is coupled to the plurality of gear shafts. Each secondary gear is coupled within the housing inside and is in operational communication with the central gear. A plurality of secondary brushes is coupled to the plurality of gear shafts. A rechargeable battery is coupled within the housing inside. The rechargeable battery is in operational communication with the motor. A control switch is coupled to the housing and is in operational communication with the rechargeable battery and the motor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
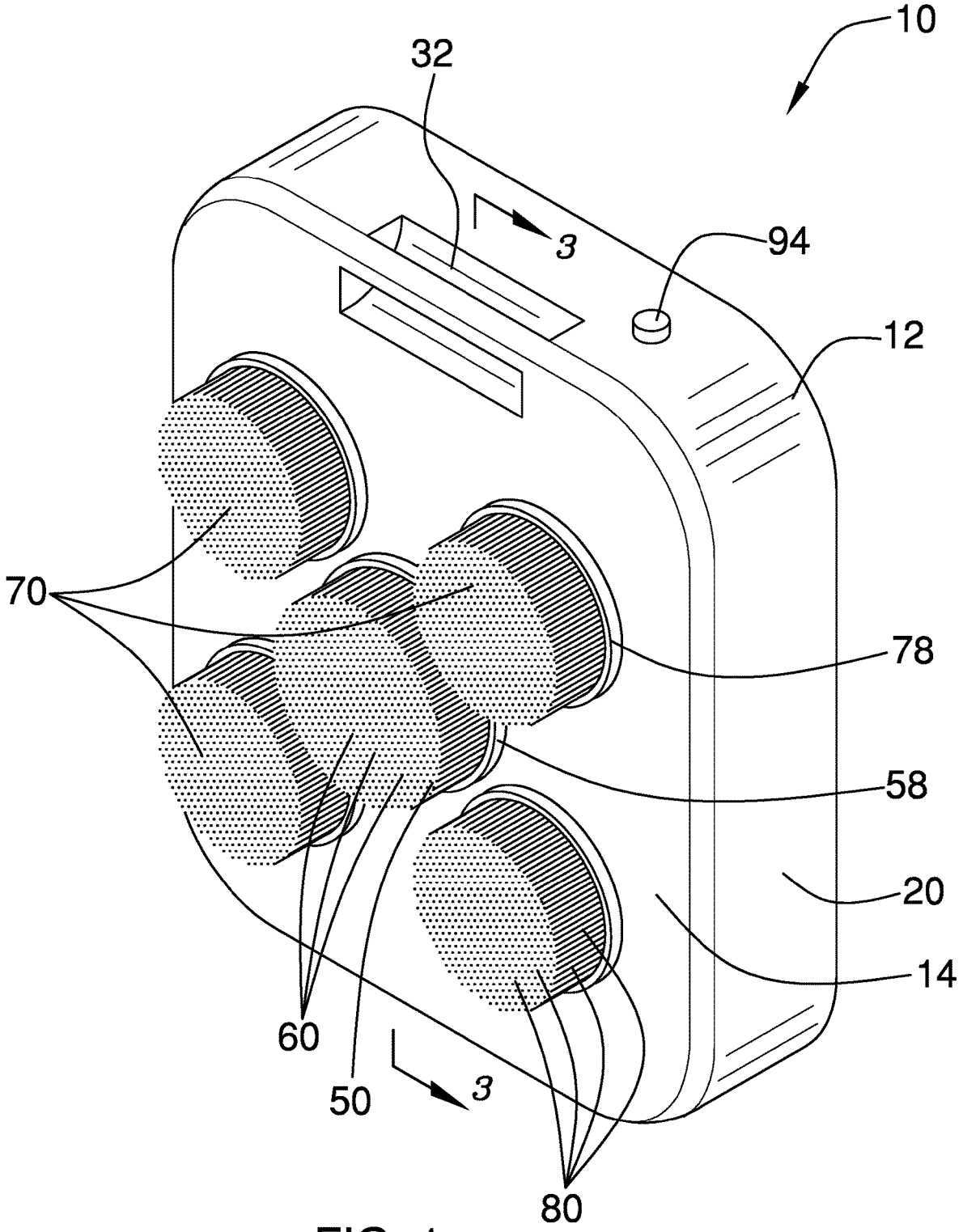
FIG. 1 is an isometric view of a wall-mounted back scrubber apparatus according to an embodiment of the disclosure.
Figure 2:
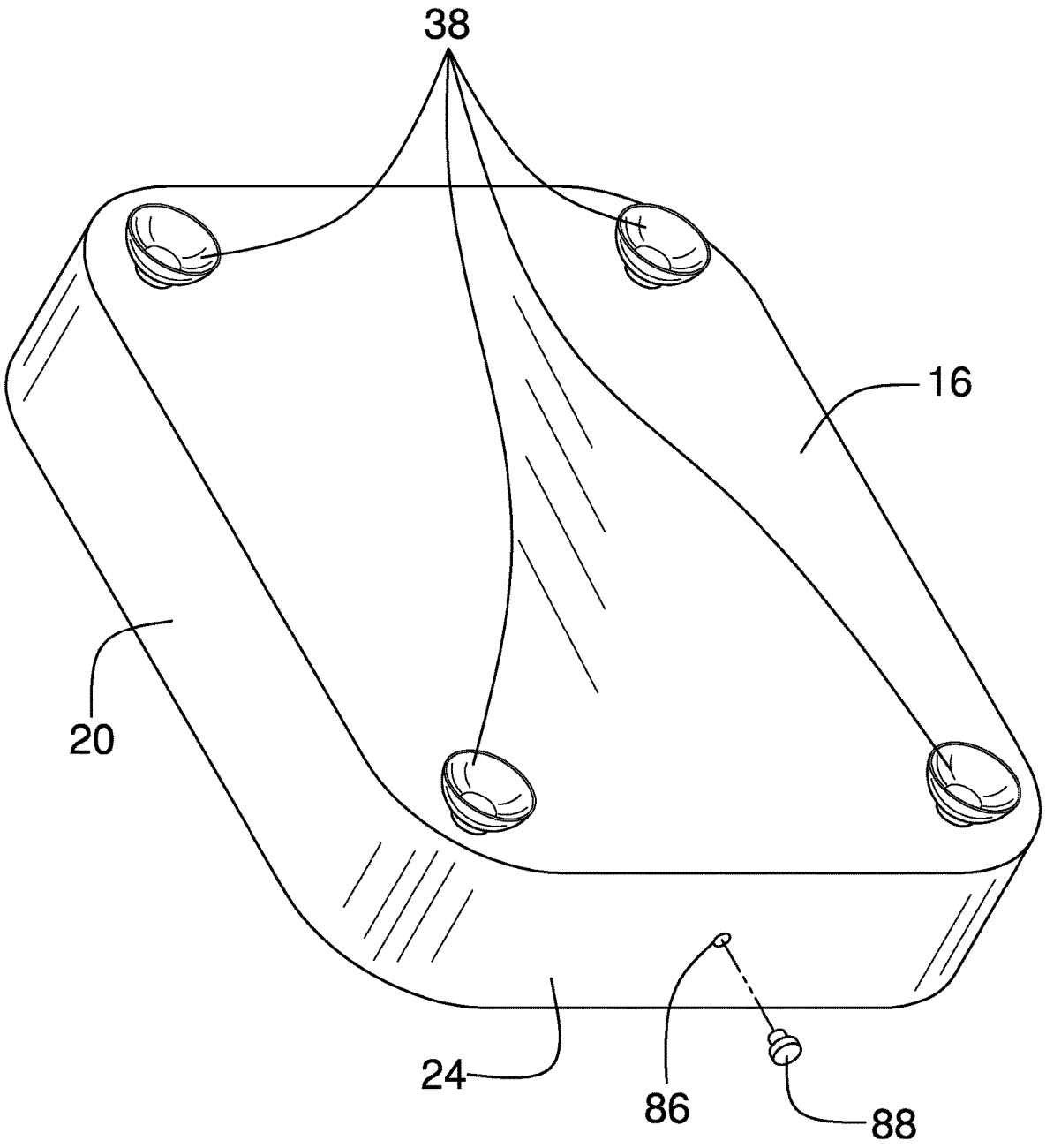
FIG. 2 is an isometric view of an embodiment of the disclosure.
Figure 3:
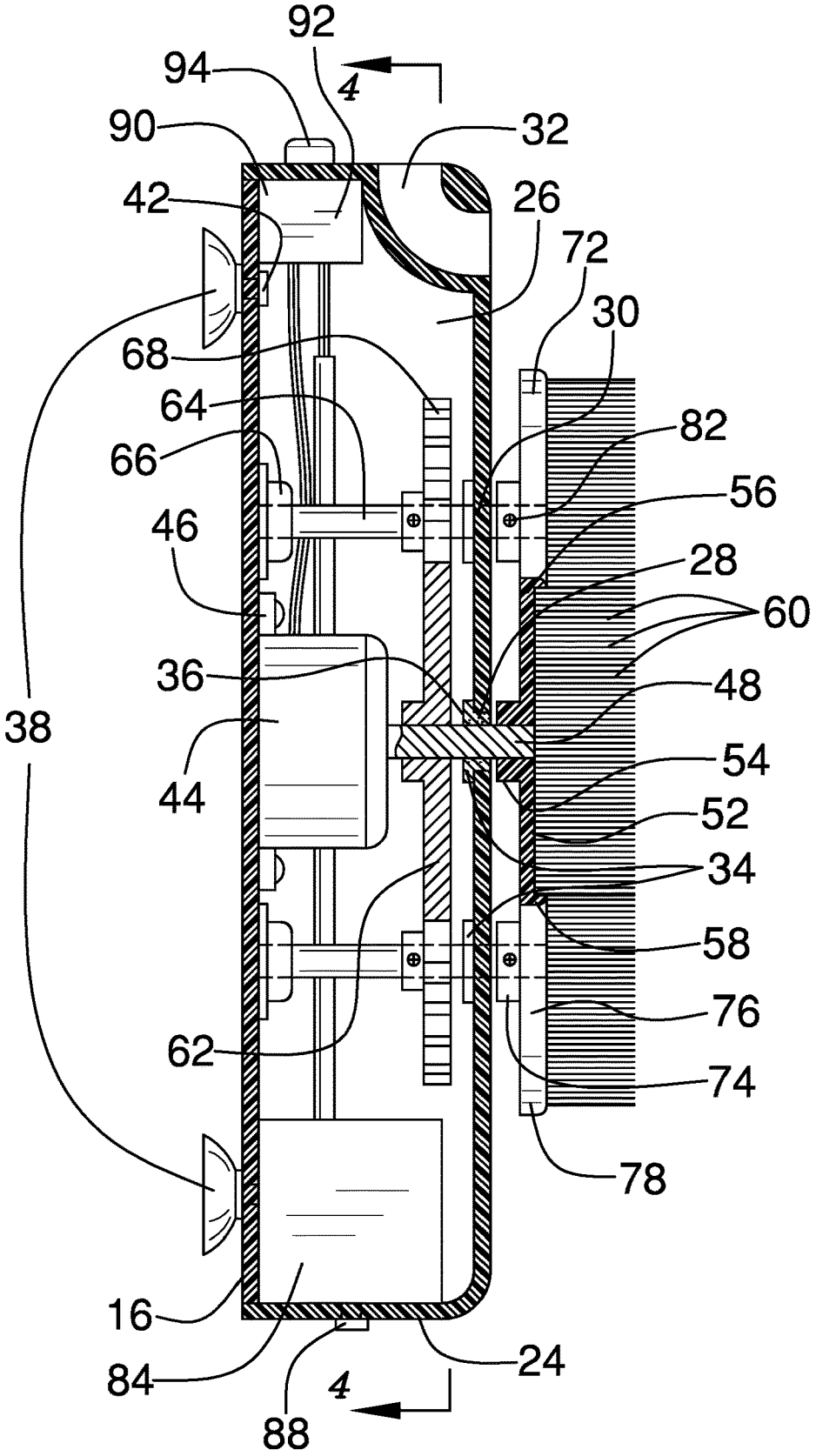
FIG. 3 is a cross-sectional view of an embodiment of the disclosure along line 3-3 of FIG. 1.
Figure 4:
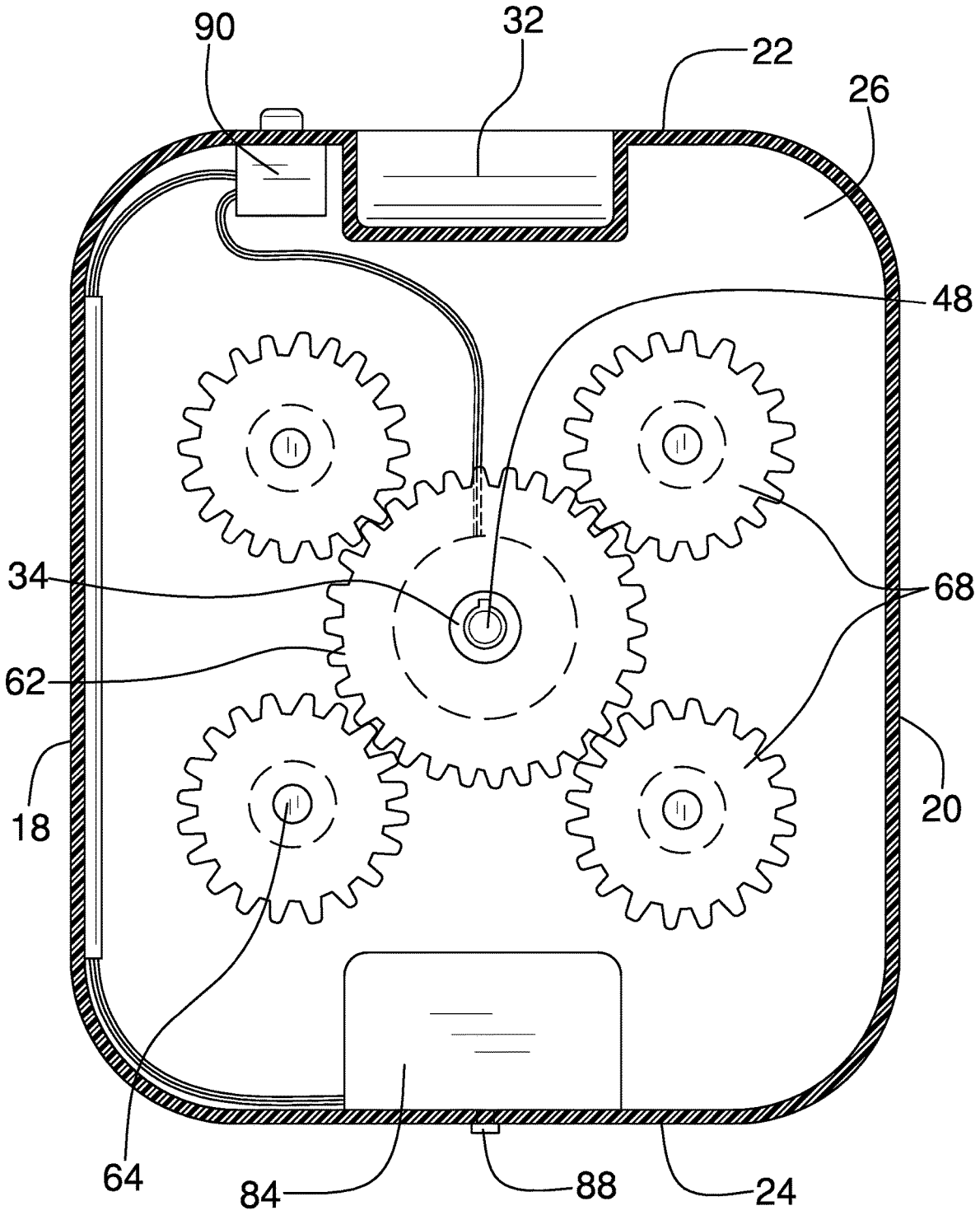
FIG. 4 is a cross-sectional view of an embodiment of the disclosure along line 4-4 of FIG. 3.
Figure 5:
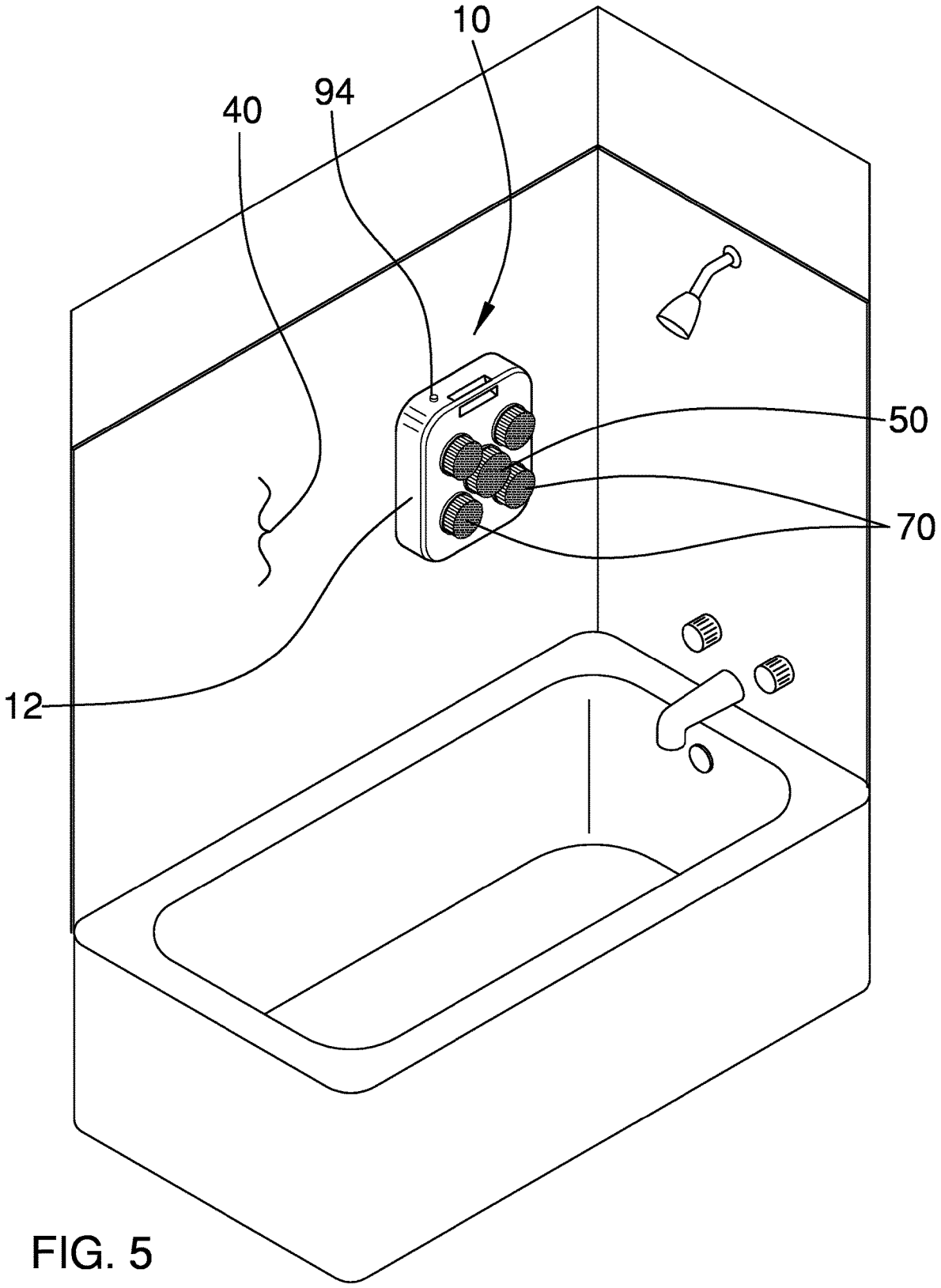
FIG. 5 is an in-use view of an embodiment of the disclosure.

With reference now to the drawings, and in particular to FIGS. 1 through 5 thereof, a new bathing accessibility device embodying the principles and concepts of an embodiment of the disclosure and generally designated by the reference numeral 10 will be described.

As best illustrated in FIGS. 1 through 5, the wall-mounted back scrubber apparatus 10 generally comprises a housing 12 having a housing front side 14, a housing back side 16, a housing left side 18, a housing right side 20, a housing top side 22, and a housing bottom side 24 defining a housing inside 26. The housing 12 may have rounded corners and the perimeter of the housing front side 14 may also be rounded to protect the user in case of accidental contact. The housing front side 14 has a central aperture 28 and a plurality of secondary apertures 30 extending through to the housing inside 26. The plurality of secondary apertures 30 may be four secondary apertures 30 arranged in a square around the central aperture 28. The housing 12 may have a handle aperture 32 extending from the housing front side 14 through the housing top side 22. The handle aperture 32 may have a 90° arc profile to comfortably accommodate the user's hand.

A plurality of bushings 34 is coupled to the housing 12. The plurality of bushings 34 is coupled within the central aperture 28 and each of the secondary apertures 30. Each bushing 34 may have a bushing collar portion 36 resting flush with the housing front side 14 within the housing inside 26. A plurality of suction cups 38 is coupled to the housing 12. Each suction cup 38 is coupled to the housing back side 16 and is configured to selectively engage a shower wall 40. There may be four suction cups 38 located proximal the corners of the housing back side 16. Each suction cup 38 may have a cup attachment portion 42 selectively engaged through the housing back side 16.

A motor 44 is coupled to the housing 12. The motor 44 may have a motor mount 46 coupled to the housing back side 16 within the housing inside 26. The motor 44 has a motor shaft 48 extending through the bushing 34 of the plurality of bushings coupled within the central aperture 28. A central brush 50 is coupled to the motor shaft 48. The central brush 50 may include a central brush back 52 having a cylindrical central collar 54 coupled around the motor shaft 48, a circular central bristle mount portion 56, and a central rim portion 58 extending from the perimeter of the circular central bristle mount portion 56. A plurality of central bristles 60 is coupled to the central bristle mount portion 56. A central gear 62 is coupled to the motor shaft 48 within the housing inside 26.

A plurality of gear shafts 64 is coupled to the housing 12. Each gear shaft 64 may have a bearing 66 coupled to the housing back side 16. Each gear shaft 64 extends through the bushing 34 of the plurality of bushings coupled within the plurality of secondary apertures 30. A plurality of secondary gears 68 is coupled to the plurality of gear shafts 64 within the housing inside 26 and is in operational communication with the central gear 62. Each secondary gear 68 may be smaller than the central gear 62 to create a faster rotational speed for the plurality of gear shafts 64 than the motor shaft 48. The plurality of bushings 34 facilitate rotation of the motor shaft 48 and the plurality of gear shafts 64 and also prevent water from entering the housing inside 26.

A plurality of secondary brushes 70 is coupled to the plurality of gear shafts 64. Each of the plurality of secondary brushes 70 may including a secondary brush back 72 having a cylindrical secondary collar 74 coupled around the respective gear shaft 64, a circular secondary bristle mount portion 76, and a secondary rim portion 78 extending from the perimeter of the circular secondary bristle mount portion 76. A plurality of secondary bristles 80 is coupled to the secondary bristle mount portion 76. The cylindrical secondary collar 74 may have a set screw 82 to selectively engage and disengage the secondary brush 70 from the respective gear shaft 64 for repair or replacement. Secondary brush heads 70 offering secondary bristles 80 of different texture, length, and stiffness may be chosen according to the user's needs and preferences.

A rechargeable battery 84 is coupled within the housing inside 26. The rechargeable battery 84 is in operational communication with the motor 44. The rechargeable battery 84 may have a charging port 86 extending through the housing bottom side 24 to receive a charging cable while not in use. A port plug 88 is selectively engageable within the charging port 86 to create a watertight seal while the apparatus 10 is in use to prevent damage to the rechargeable battery 84. A control switch 90 is coupled to the housing 12 and is in operational communication with the rechargeable battery 84 and the motor 44. The control switch 90 may include a switch housing 92 coupled to the housing top side 22 within the housing inside 26 and a switch button 94 extending through the housing top side 22.

In use, the apparatus 10 is fixed to the shower wall 40 with the plurality of suction cups 38. The control switch 90 is manipulated to activate the motor 44 and begin rotation of the central brush 50 and the plurality of secondary brushes 70. The user may then press his or her back against the apparatus 10 for thorough cleaning. When necessary, the apparatus 10 is disengaged from the shower wall 40 and the port plug 88 is removed to engage the charging cable to charging port 86 to charge the rechargeable battery 84.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wall-mounted back scrubber apparatus comprising:

a housing having a housing front side, a housing back side, a housing left side, a housing right side, a housing top side, and a housing bottom side defining a housing inside, the housing front side having a central aperture and a plurality of secondary apertures extending through to the housing inside;

a plurality of suction cups coupled to the housing, each suction cup being coupled to the housing back side and being configured to selectively engage a shower wall;

a motor coupled to the housing within the housing inside, the motor having a motor shaft extending through the central aperture;

a central brush coupled to the motor shaft;

a central gear coupled to the motor shaft within the housing inside;

a plurality of gear shafts coupled to the housing, each gear shaft being rotatably coupled to the housing back side and extending through the plurality of secondary apertures;

a plurality of secondary gears coupled to the plurality of gear shafts, each secondary gear being coupled within the housing inside and being in operational communication with the central gear;

a plurality of secondary brushes coupled to the plurality of gear shafts;

a rechargeable battery coupled within the housing inside, the rechargeable battery being in operational communication with the motor; and a control switch coupled to the housing, the control switch being in operational communication with the rechargeable battery and the motor.

2. The wall-mounted back scrubber apparatus of claim 1 further comprising the plurality of secondary apertures being four secondary apertures arranged in a square around the central aperture.

3. The wall-mounted back scrubber apparatus of claim 1 further comprising a plurality of bushings coupled within the central aperture and each of the secondary apertures, each bushing rotatably receiving the motor shaft and the plurality of gear shafts, respectively.

4. The wall-mounted back scrubber apparatus of claim 1 further comprising each of the plurality of gear shafts having a bearing coupled to the housing back side.

5. The wall-mounted back scrubber apparatus of claim 1 further comprising the housing having a handle aperture extending from the housing front side through the housing top side.

6. The wall-mounted back scrubber apparatus of claim 5 further comprising the handle aperture having a 90° arc profile.

7. The wall-mounted back scrubber apparatus of claim 1 further comprising the rechargeable battery having a charging port extending through the housing bottom side; a port plug being selectively engageable and creating a watertight seal within the charging port.

8. The wall-mounted back scrubber apparatus of claim 1 further comprising the central brush including a central brush back coupled to the motor shaft and a plurality of central bristles coupled to the central brush back; each of the plurality of secondary brushes including a secondary brush back coupled to the respective gear shaft and a plurality of secondary bristles coupled to the secondary brush back.

9. The wall-mounted back scrubber apparatus of claim 8 further comprising the central brush back having a cylindrical central collar coupled around the motor shaft, a circular central bristle mount portion, and a central rim portion extending from the perimeter of the circular central bristle mount portion; each secondary brush back having a cylindrical secondary collar coupled around the respective gear shaft, a circular secondary bristle mount portion, and a secondary rim portion extending from the perimeter of the circular secondary bristle mount portion.

10. A wall-mounted back scrubber apparatus comprising:

a housing having a housing front side, a housing back side, a housing left side, a housing right side, a housing top side, and a housing bottom side defining a housing inside, the housing front side having a central aperture and a plurality of secondary apertures extending through to the housing inside, the plurality of secondary apertures being four secondary apertures arranged in a square around the central aperture, the housing having a handle aperture extending from the housing front side through the housing top side, the handle aperture having a 90° arc profile;

a plurality of bushings coupled to the housing, the plurality of bushings being coupled within the central aperture and each of the secondary apertures;

a plurality of suction cups coupled to the housing, each suction cup being coupled to the housing back side and being configured to selectively engage a shower wall;

a motor coupled to the housing within the housing inside, the motor having a motor shaft extending through the bushing of the plurality of bushings coupled within the central aperture;

a central brush coupled to the motor shaft, the central brush including a central brush back having a cylindrical central collar coupled around the motor shaft, a circular central bristle mount portion, and a central rim portion extending from the perimeter of the circular central bristle mount portion, a plurality of central bristles being coupled to the central bristle mount portion;

a central gear coupled to the motor shaft within the housing inside;

a plurality of gear shafts coupled to the housing, each gear shaft having a bearing coupled to the housing back side, each gear shaft extending through the bushing of the plurality of bushings coupled within the plurality of secondary apertures;

a plurality of secondary gears coupled to the plurality of gear shafts, each secondary gear being coupled within the housing inside and being in operational communication with the central gear;

a plurality of secondary brushes coupled to the plurality of gear shafts, each of the plurality of secondary brushes including a secondary brush back having a cylindrical secondary collar coupled around the respective gear shaft, a circular secondary bristle mount portion, and a secondary rim portion extending from the perimeter of the circular secondary bristle mount portion, a plurality of secondary bristles being coupled to the secondary bristle mount portion;

a rechargeable battery coupled within the housing inside, the rechargeable battery being in operational communication with the motor, the rechargeable battery having a charging port extending through the housing bottom side;

a port plug being selectively engageable and creating a watertight seal within the charging port; and a control switch coupled to the housing, the control switch being in operational communication with the rechargeable battery and the motor.

* * * * *